US006406305B1

(12) United States Patent
Wu

(10) Patent No.: US 6,406,305 B1
(45) Date of Patent: Jun. 18, 2002

(54) ELECTRICAL CONNECTOR HAVING COMPRESSION TERMINAL MODULE THEREIN

(75) Inventor: Jerry Wu, Pan-Chiao (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/839,332

(22) Filed: Apr. 20, 2001

(51) Int. Cl.[7] ..... H01R 12/00
(52) U.S. Cl. ..... 439/65; 439/629
(58) Field of Search ..... 439/65, 66, 62, 439/629, 630

(56) References Cited

U.S. PATENT DOCUMENTS 6,077,130 A * 6/2000 Hughes et al. ..... 439/802
6,247,938 B1 * 6/2001 Rathburn ..... 439/66
6,253,451 B1 * 7/2001 Semmeling et al. ..... 439/65

* cited by examiner

*Primary Examiner*—Khiem Nguyen
(74) *Attorney, Agent, or Firm*—Wei Te Chung

(57) ABSTRACT

An electrical connector (2) interconnects a first PCB (50) and a second PCB (52) arranged vertical to the first PCB, and includes an insulative housing (4) and a plurality of terminal modules (6). The insulative housing has a top surface (22) and a bottom surface (24) and a cavity (18) defined between the top surface and the bottom surface. Each terminal module is received in the cavity and comprises a first terminal (8) and a second terminal (10). The first terminal has a first limb (28) and a second limb (30), wherein the first limb projects beyond the top surface of the insulative housing for engaging the first board. The second terminal has an engaging portion (44) aligned with the second limb, and the engaging portion and the second limb define a passageway for clamping the second board therebetween.

16 Claims, 8 Drawing Sheets

ELECTRICAL CONNECTOR HAVING COMPRESSION TERMINAL MODULE THEREIN

BACKGROUND OF THE INVENTION

1. Field of the Invention

The present invention relates to an electrical connector, and particularly to an electrical connector having a compression terminal module therein to reliably combine two separated printed circuit boards (hereinafter PCB).

2. Description of Related Art

U.S. Pat. No. 5,891,591 discloses a battery terminal which comprises a housing and a plurality of contacts mounted in the housing. Each contact includes a base portion and a free triangular portion at two ends thereof, and the triangular portion is extended outward beyond a surface of the housing. The contacts connect two separated PCBs at the base portions and the triangular portions, respectively. However, if the two separated PCBs are arranged non-aligned to corresponding base portion and triangular portion for certain reasons, such as assembly tolerance, then the contacts may not have enough engaging area with the PCBs. In addition, since the base portions only extends outward from the housing, the base portions lacks resilient adjusting by itself. Thus, the combination between the two PCBs via the contacts is not reliable for above reasons, particular to the two separated PCBs arranged vertical to each other.

SUMMARY OF THE INVENTION

Accordingly, the object of the present invention is to provide an electrical connector having compression terminal module therein to obtain reliable combination between two separated PCBs.

In order to achieve the object set forth, an electrical connector is adapted to connect a first PCB and a second PCB arranged vertical to the first PCB, and includes an insulative housing and a plurality of terminal modules. The insulative housing has a top surface and a bottom surface and a cavity defined between the top surface and the bottom surface. Each terminal module is received in the cavity and comprises a first terminal and a second terminal. The first terminal has a first limb and a second limb, wherein the first limb projects beyond the top surface of the insulative housing for engaging a first board. The second terminal has an engaging portion aligned with the second limb, and the engaging portion and the second limb define a passageway therebetween for clamping a second board.

Other objects, advantages and novel features of the invention will become more apparent from the following detailed description when taken in conjunction with the accompanying drawings.

DETAILED DESCRIPTION OF THE INVENTION

Figure 1:
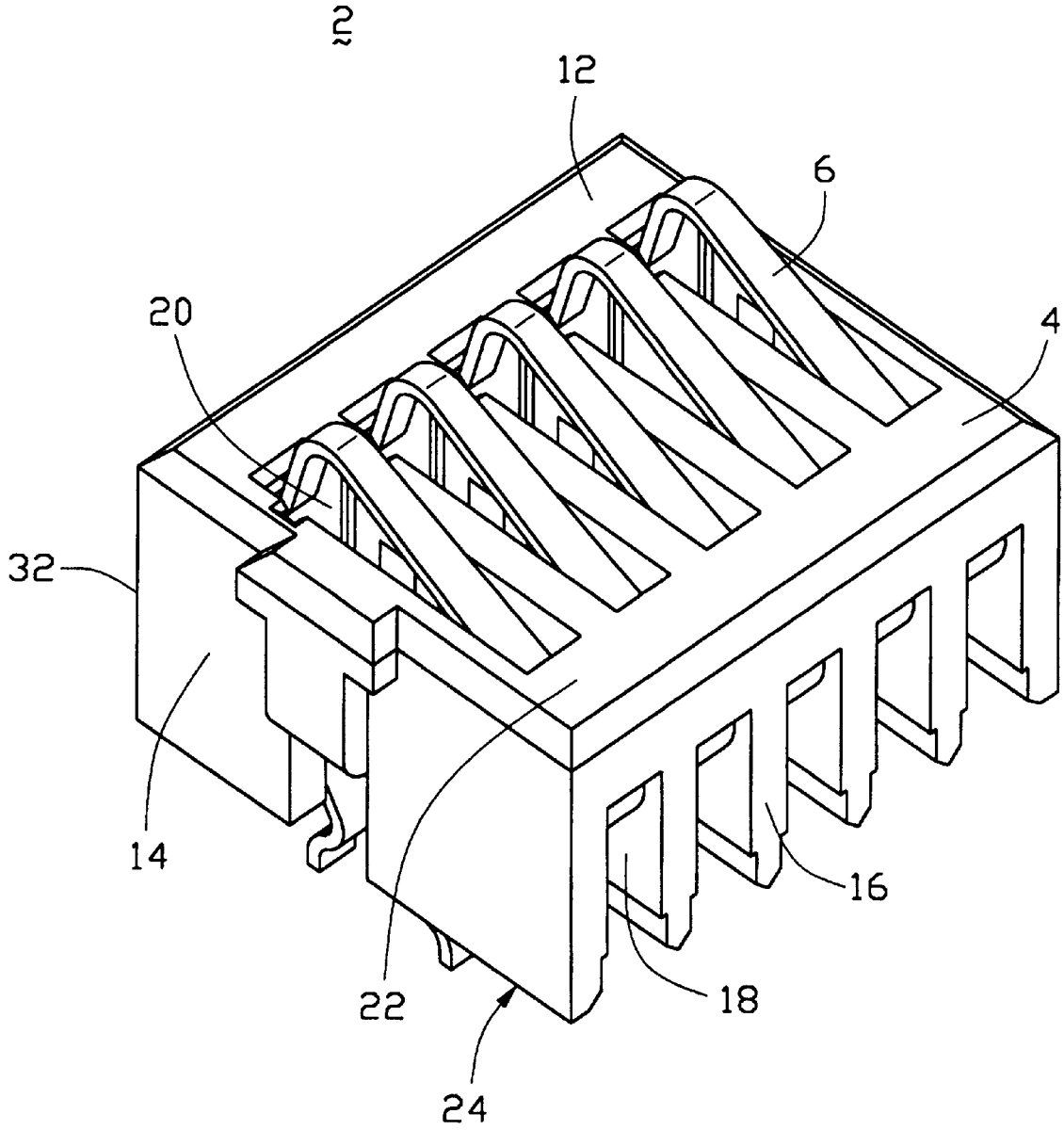
FIG. 1 is a perspective view of an electrical connector in accordance with the present invention.
Figure 2:
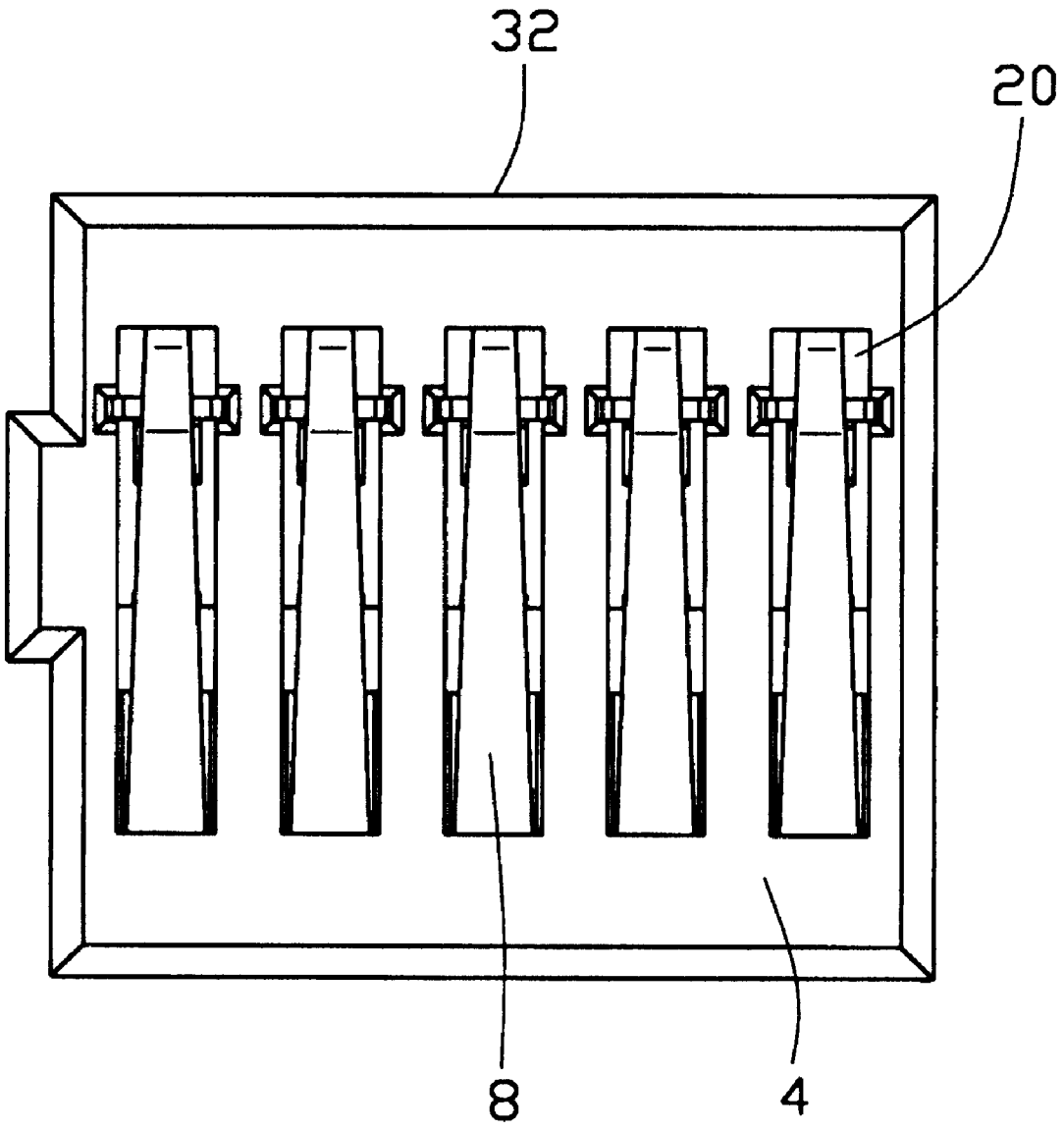
FIG. 2 is a top view of the electrical connector shown in FIG. 1.
Figure 3:
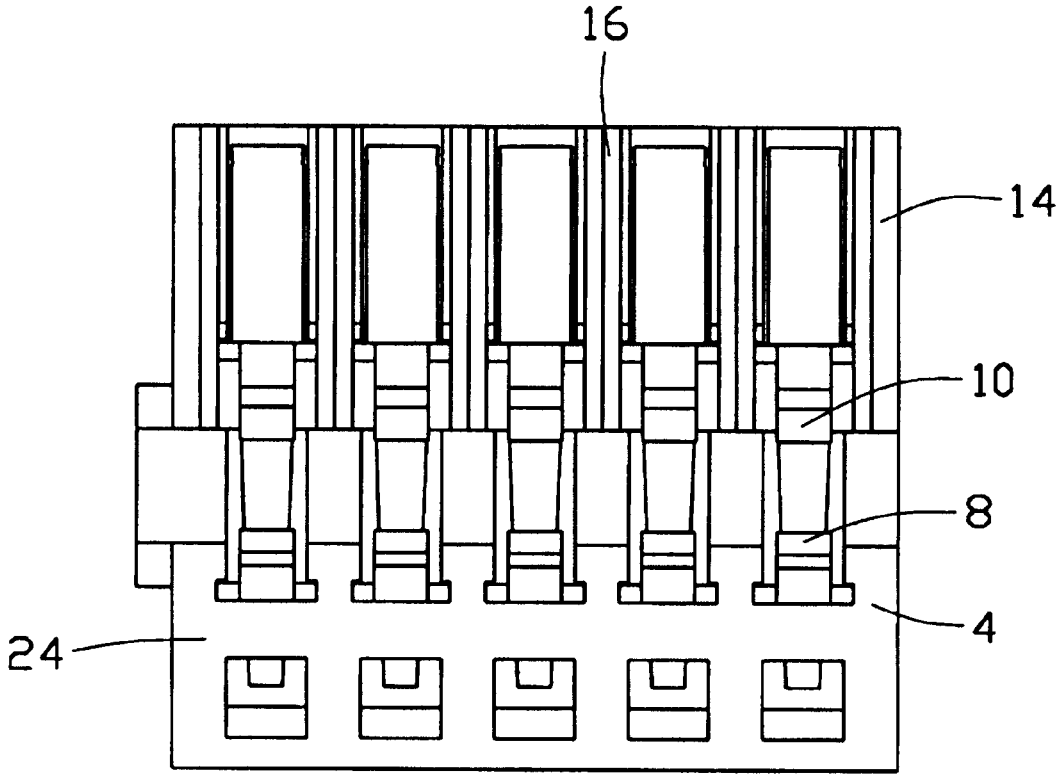
FIG. 3 is a bottom view of the electrical connector shown in FIG. 1.
Figure 4:
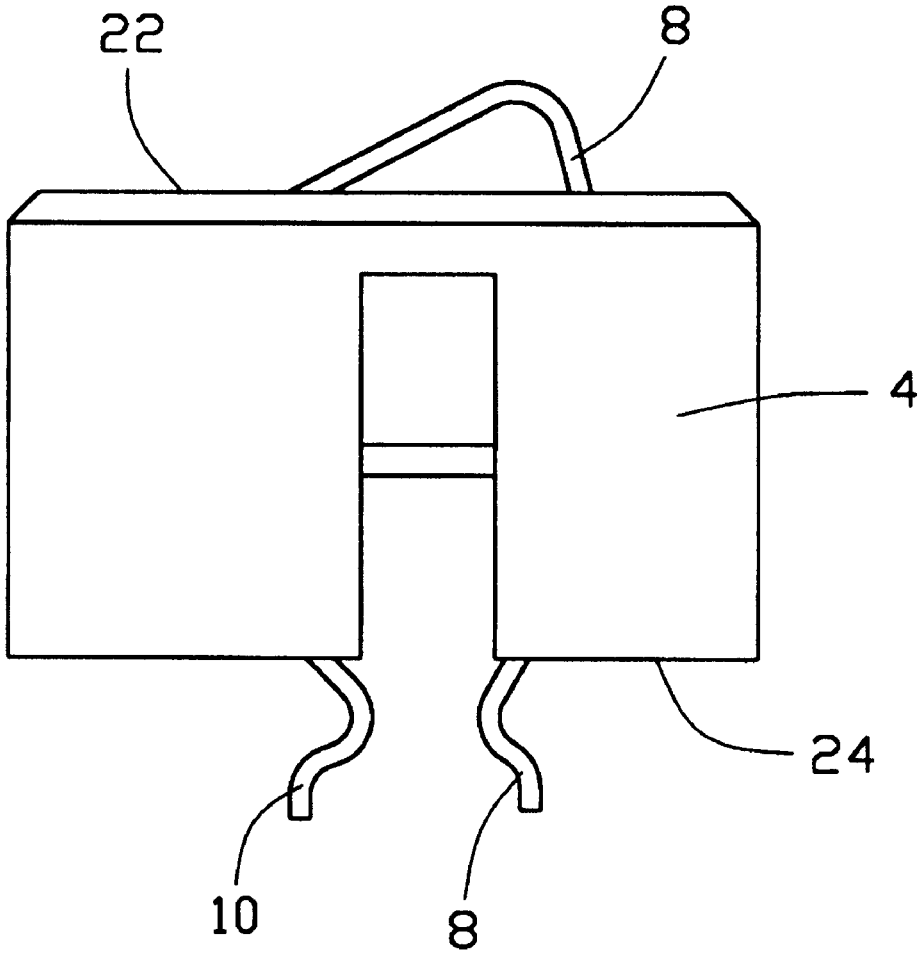
FIG. 4 is a side view of the electrical connector shown in FIG. 1.
Figure 5:
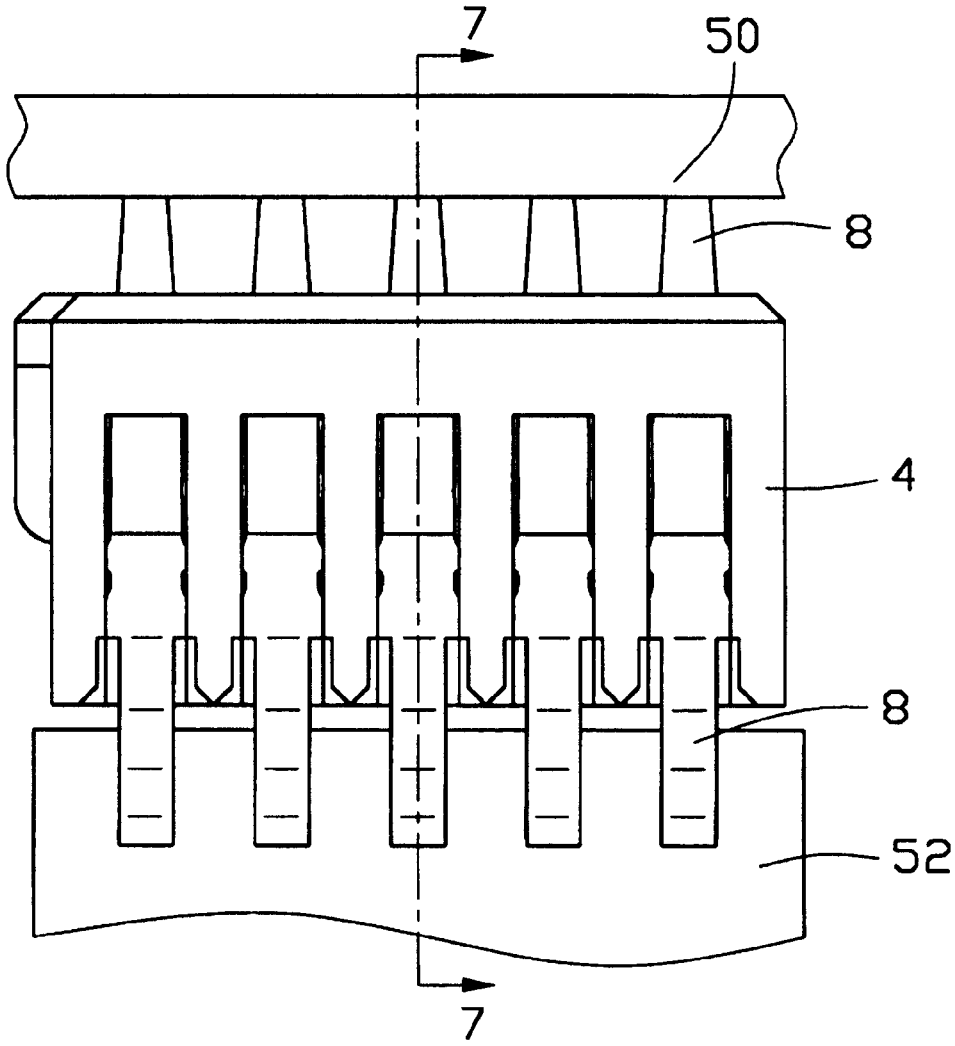
FIG. 5 is a front view of the electrical connector shown in FIG. 1 and two separated PCBs.

Referring to FIGS. 1–6, an electrical connector 2 of the present invention comprises an insulative housing 4 and a plurality of terminal modules 6 received in the insulative housing 4 and spaced from each other. In the embodiment illustrated, five terminal modules 6 are mounted to the insulative housing 6. The insulative housing 6 comprises a top wall 12, two side walls 14, a front wall 32 and four interior walls 16 arranged parallel to the two side walls 14. Five cavities 18 are defined between the four interior walls 16 and the two side walls 14 to receive the five terminal modules 6. The insulative housing forms five openings 20 in the top wall 12 for extension of the five terminal modules 6. In addition, a top surface 22 is defined on the top wall 12 and a bottom surface 24 is defined opposite to the top surface 22.

Figure 6:
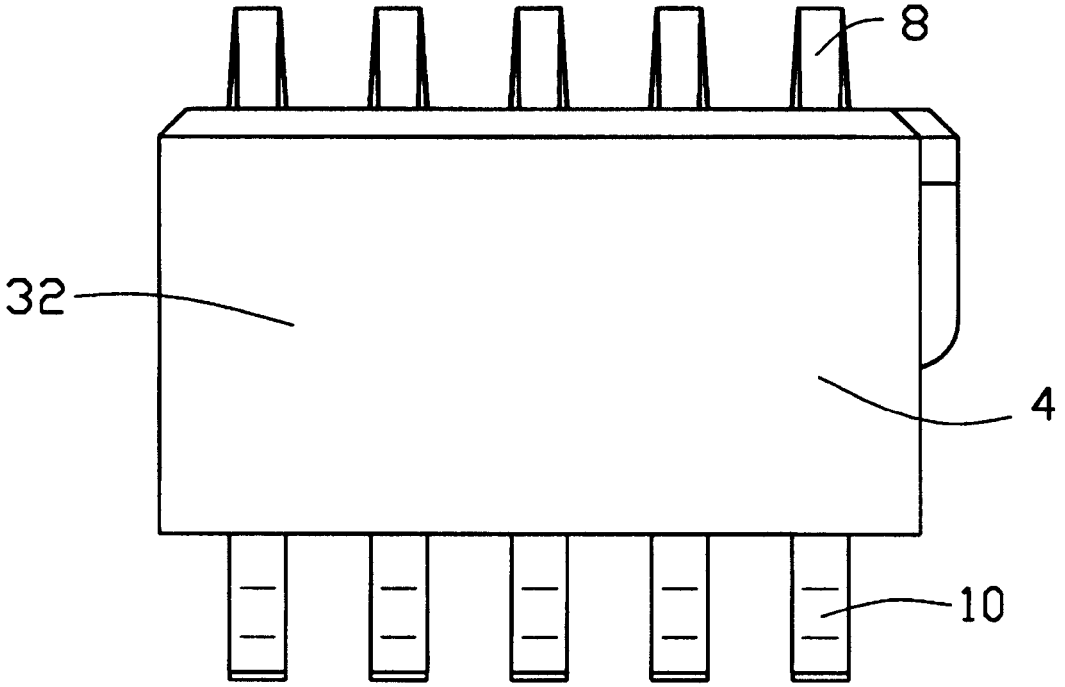
FIG. 6 is a back view of the electrical connector shown in FIG. 1.
Figure 7:
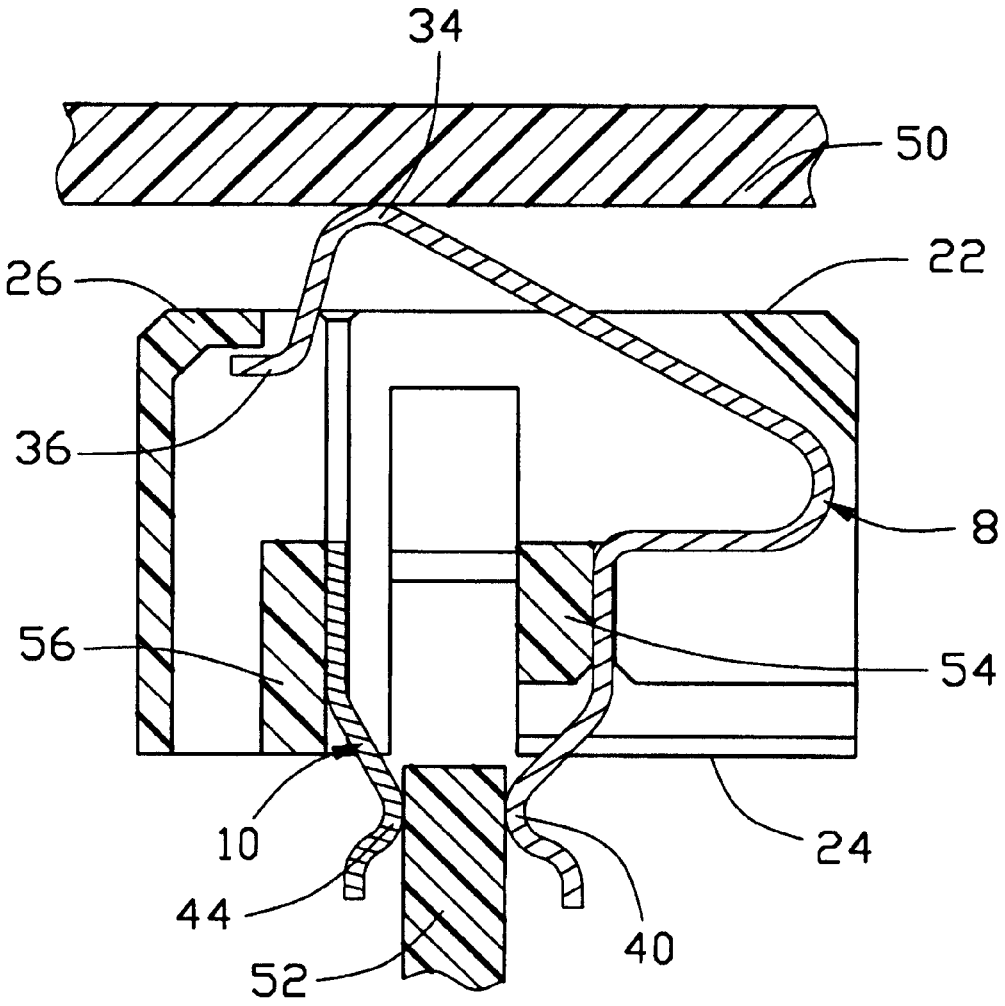
FIG. 7 is a cross-sectional view of the electrical connector and the two separated PCBs taken along line 7—7 in FIG. 5.
Figure 8:
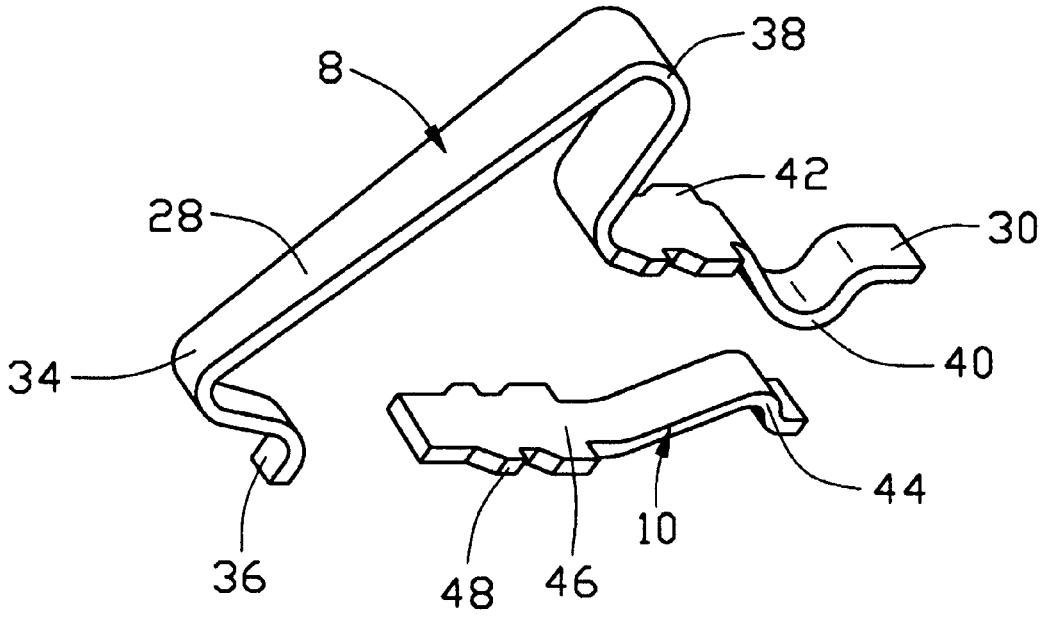
FIG. 8 is a terminal module in accordance with the present invention.

Also referring to FIGS. 6–8, each terminal module 6 comprises a first terminal 8 and a second terminal 10. The first terminal 8 and the second terminal 10 can be attached to the cavities 18 of the insulative housing 4 by any known means, such as by inserting the first terminal 8 along a direction which is from the bottom surface 24 to the top surface 22. Each first terminal 8 has a first limb 28 partially extending beyond the top surface 22 of the insulative housing 4, a second limb 30 partially extending beyond the bottom surface 24 of the insulative housing 4, and a connection section 38 positioned between the first limb 28 and the second limb 30. The first limb 28 has an arcuate section 34 for engaging with a first PCB 50 and a free end 36 extending from the arcuate section 34. Because the connection section 38 can freely deform, so that the first limb 28 can resiliently deflectable upon being acted by an external force. The second limb 30 forms a substantially V-shaped, convex engaging section 40.

The second terminal 10 includes a V-shaped engaging portion 44 and a flat portion 46. The first terminal 8 comprises multiple teeth 42 extending from two sides of the second limb 30. Similarly, the second terminal 10 comprises multiple teeth 48 extending from two sides of the flat portion 46, wherein the teeth 42 and 48 engage with corresponding cavity walls during inserting into the cavities 18 of the insulative housing 4 for locating the terminal module 6 in position.

The insulative housing 4 defines a baffle 26 at an edge of the opening 20 (see FIG. 7) for pre-loading and restraining the free end 36 of the first terminal 8. In the embodiment illustrated, each opening 20 is rectangular, having opposite longitudinal edges and opposite end edges. The distance between longitudinal edges is designed in view of a width of the first limb 28 of the first terminal 8 whereby the longitudinal edges of the opening 20 assist in guiding the movement of the second limb 30 and maintain the second limb 30 in position.

The insulative housing 4 defines ribs 54 and 56. In assembly, the first terminal 8 and the second terminal 10 are retained in the insulative housing 4 by engagement of the teeth 42 and 48 with the ribs 54 and 56, respectively. The engaging section 40 of the first terminal 8 and engaging portion 44 of the second terminal 10 outwardly project beyond the bottom surface 24 to thereby define a passageway therebetween, and the arcuate section 34 of the first terminal 8 outwardly projects beyond the top surface 22. The free end 36 of the first terminal 8 engages with the baffle 26 of the insulative housing 4. Furthermore, the engaging section 40 of the first terminal 8 aligns with the engaging portion 44 of the second terminal 10.

When the connector 2 interconnects a first PCB 50 to a second PCB 52 together, wherein the first PCB 50 is vertical to the second PCB 52, the arcuate section 34 of the first terminal 8 is compressed by the first PCB 50, and the second PCB 52 is inserted into the passageway, whereby both the engaging section 40 and the engaging portion 44 are displaced by and therefore clamp the second PCB 52. At the same time, the free end 36 of the first terminal 8 separates from the baffle 26. During mating, only the first terminal 8 electrically contacts with the second PCB 52, while the second terminal 10 merely mechanical contacts with and resiliently supports the second PCB 52. In other words, the second terminal 10, which may be deemed the dummy terminal and have the different configuration from the first terminal 8 without at least any electrical, or even mechanical, contact portion engaging the first PCB 50 while with the only mechanical contact portion engaging the second PCB 52,only serves essentially as an assistant underlay. In particular, even if the second PCB 52 is non-parallel to the second limb 30, the second terminal 10 would provide resilient force to locate the second PCB 52 in scheduled position. By the design of the second terminal 10, the second PCB 52 can reliably assembled in position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted to connect a first printed circuit board and a second printed circuit board arranged vertical to the first printed circuit board, said electrical connector comprising:

an insulative housing having a top surface, a bottom surface, and a cavity defined between the top surface and the bottom surface; and a terminal module received in the cavity, and comprising:

a first terminal having a first limb and a second limb, the first limb projecting beyond the top surface of the insulative housing for electrically and mechanically engaging with the first printed circuit board; and a second terminal being separate from the first terminal and having an engaging portion aligned with the second limb, the engaging portion only mechanically while not electrically engaged with the second printed circuit board, the engaging portion and the second limb defining a passageway for clamping the second printed circuit board therebetween.

2. The electrical connector as described in claim 1, wherein the insulative housing comprises an opening through the top surface for extension of the first limb.

3. The electrical connector as described in claim 2, wherein the first limb has an arcuate section and a free end extending from the arcuate section, and the insulative housing defines a baffle at edge of the opening for resiliently retaining the free end of the first limb.

4. The electrical connector as described in claim 1, wherein the first terminal comprises a connection section between the first limb and the second limb for facilitating a resiliently deflected movement of the first limb upon being acted by an external force.

5. The electrical connector as described in claim 1, wherein the first limb is resiliently displaceable along a first direction and the second limb is resiliently displaceable along a second direction perpendicular to the first direction.

6. The electrical connector as described in claim 1, wherein both the second limb of the first terminal and the engaging portion of the second terminal project beyond the bottom surface of the housing.

7. An electrical connector comprising:

an insulative housing defining at least one cavity therein;

a first terminal disposed on one side of the cavity, said first terminal defining a first contact portion for mechanically and electrically engaging a first electronic component, and a second contact portion for mechanically and electrically engaging a second electronic component; and a second terminal being separate from the first terminal and disposed on another side of the cavity and defining no contact portion for mechanically and electrically engaging the first electronic component, while defining a third contact portion only for mechanically while not electrically engaging the second electronic component.

8. The connector as described in claim 7, wherein said second contact portion of the first terminal and said third contact portion of the second terminal face to each other with a space therebetween for sandwiching the second electronic component therein.

9. An electrical connector assembly comprising:

a connector and first and second electronic components;

said connector including:

an insulative housing defining at least one cavity therein;

a first terminal disposed on one side of the cavity, said first terminal defining a first contact portion for mechanically and electrically engaging a first electronic component, and a second contact portion for mechanically and electrically engaging a second electronic component; and a second terminal being separate from the first terminal and disposed on another side of the cavity and defining no contact portion mechanically and electrically engaging the first electronic component, while defining a third contact portion only for mechanically while not for electrically engaging the second electronic component.

10. The connector as described in claim 9, wherein said second contact portion of the first terminal and said third contact portion of the second terminal face to each other with a space therebetween, sandwiching the second electronic component therein.

11. The connector as described in claim 9, wherein said first electronic component is a first printed circuit board, and said second electronic component is a second printed circuit board.

12. The connector as described in claim 11, wherein said first and second printed circuit boards are perpendicular to each other.

13. An electrical connector assembly for use with an electronic component, said assembly comprising:

an electrical connector and a printed circuit board, said electrical connector including an insulative housing defining at least two faces thereon;

at least one real terminal disposed in the housing, said real terminal defining a first real contact portion exposed around one of said two faces for at least electrically engaging said electronic component, and a second real contact portion exposed around the other of said two faces and at least electrically engaging said printed circuit board; and at least one dummy terminal disposed in the housing opposite to the real terminal, said dummy terminal providing no electrical function thereof while abutting against said printed circuit board to provide mechanical function thereof.

14. The assembly as described in claim 13, wherein said second real contact portion cooperates with said dummy terminal around the other of said two faces to mechanically retain the printed circuit board therebetween.

15. The assembly as described in claim 13, wherein said dummy terminal and said real terminal are located in a same plane.

16. The assembly as described in claim 13, wherein said dummy terminal is made of metal.

* * * * *